US012410927B2

(12) United States Patent
Yang et al.

(10) Patent No.: US 12,410,927 B2
(45) Date of Patent: Sep. 9, 2025

(54) HEAT PUMP SYSTEM, CONTROL METHOD AND APPARATUS THEREOF, AIR CONDITIONING DEVICE AND STORAGE MEDIUM

(71) Applicant: Gree Electric Appliances, Inc. of Zhuhai, Guangdong (CN)

(72) Inventors: Zhifeng Yang, Guangdong (CN); Wenchao You, Guangdong (CN); Yongfu Dai, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 302 days.

(21) Appl. No.: 18/015,571

(22) PCT Filed: Nov. 3, 2021

(86) PCT No.: PCT/CN2021/128424
§ 371 (c)(1),
(2) Date: Jan. 11, 2023

(87) PCT Pub. No.: WO2022/105605
PCT Pub. Date: May 27, 2022

(65) Prior Publication Data

US 2023/0250982 A1 Aug. 10, 2023

(30) Foreign Application Priority Data

Nov. 18, 2020 (CN) ..... 202011297044

(51) Int. Cl.
*F24F 11/41* (2018.01)
*F24F 11/65* (2018.01)
(Continued)

(52) U.S. Cl.
CPC ..... *F24F 11/41* (2018.01); *F24F 11/65* (2018.01); *F24F 11/84* (2018.01); *F25B 30/00* (2013.01);
(Continued)

(58) Field of Classification Search
CPC ..... H04B 10/60; H04B 10/66; H04B 10/69; H04B 10/693
See application file for complete search history.

(56) References Cited

U.S. PATENT DOCUMENTS 4,878,357 A 11/1989 Sekigami et al.
5,277,034 A 1/1994 Hojo et al.
(Continued)

FOREIGN PATENT DOCUMENTS

CN 101487609 A 7/2009
CN 109341156 A 2/2019
(Continued)

OTHER PUBLICATIONS

Extended European Search Report, EP 21893752, Feb. 1, 2024.
Notice of First Examination Opinion, CN 202011297044.7, Jan. 19, 2024.

*Primary Examiner* — Henry T Crenshaw
(74) *Attorney, Agent, or Firm* — The Webb Law Firm

(57) ABSTRACT

This disclosure provides a heat pump system, a control method and apparatus thereof, an air conditioning device and a storage medium, and relates to the field of heat pump technology, wherein the heat pump system includes: a valve assembly being respectively connected with an exhaust outlet and a suction inlet of a compressor, a first end of a second indoor heat exchanger, and a first end of an outdoor unit, and a second end of the second indoor heat exchanger being connected with a second end of the outdoor unit; the valve assembly being configured to control a flow direction and on-off of refrigerant to form a refrigerant loop; and a
(Continued)

first control valve being provided in a pipeline between the first end of the first indoor heat exchanger and the exhaust outlet of the compressor.

15 Claims, 7 Drawing Sheets

(51) Int. Cl.
*F24F 11/84* (2018.01)
*F25B 30/00* (2006.01)
*F25B 41/20* (2021.01)

(52) U.S. Cl.
CPC .... *F25B 41/20* (2021.01); *F25B 2313/02742* (2013.01); *F25B 2313/02791* (2013.01)

(56) References Cited

U.S. PATENT DOCUMENTS

| | | | | |
|---|---|---|---|---|
| 10,571,173 | B2 | 2/2020 | Tanaka et al. | |
| 2002/0017381 | A1* | 2/2002 | Ozaki | F28F 1/128 165/135 |
| 2015/0292508 | A1* | 10/2015 | Ikeda | F24F 1/0057 415/208.2 |
| 2019/0360705 | A1* | 11/2019 | Muramatsu | F24F 1/24 |

FOREIGN PATENT DOCUMENTS

| | | | | |
|---|---|---|---|---|
| CN | 109386886 | A | | 2/2019 |
| CN | 109631427 | A | | 4/2019 |
| CN | 110173917 | A | | 8/2019 |
| CN | 110657505 | A | | 1/2020 |
| CN | 210118895 | U | | 2/2020 |
| CN | 111336711 | A | | 6/2020 |
| CN | 111630331 | A | | 9/2020 |
| CN | 111765568 | A | | 10/2020 |
| CN | 111811035 | A | | 10/2020 |
| CN | 112556233 | A | | 3/2021 |
| CN | 213480647 | U | | 6/2021 |
| EP | 2 295 896 | | * | 8/2010 |
| EP | 2295896 | A2 | | 3/2011 |
| JP | 2001317831 | A | | 11/2001 |
| JP | 2004020086 | A | | 1/2004 |
| JP | 2010002124 | A | | 1/2010 |
| KR | 1020090124226 | A | | 12/2009 |
| KR | 1020160098755 | A | | 8/2016 |
| KR | 1020170070865 | A | | 6/2017 |
| WO | 2020113938 | A1 | | 6/2020 |

* cited by examiner

HEAT PUMP SYSTEM, CONTROL METHOD AND APPARATUS THEREOF, AIR CONDITIONING DEVICE AND STORAGE MEDIUM

CROSS-REFERENCE TO RELATED APPLICATIONS

This application is the United States national phase of International Application No. PCT/CN2021/128424 filed Nov. 3, 2021, and claims priority to Chinese Patent Application No. 202011297044.7 filed Nov. 18, 2020, the disclosures of which are hereby incorporated by reference in their entireties.

BACKGROUND OF THE INVENTION

Field of the Invention

This disclosure relates to the technical field of heat pump, and in particular, to a heat pump system, a control method and apparatus thereof, an air conditioning device, and a storage medium.

Description of Related Art

Currently, an air conditioning device, such as a thermostat and humidistat, is generally provided with an electric heating function. In use of the thermostat and humidistat, when indoor humidity is greater than set humidity and indoor temperature is less than or equal to set temperature, the electric heating function is started to avoid temperature overshoot, and an electric heating system performs indoor heating.

SUMMARY OF THE INVENTION

The present disclosure provides a heat pump system, a control method and apparatus thereof, an air conditioning device and a storage medium.

According to a first aspect of the present disclosure, there is provided a heat pump system, comprising: an indoor unit, an outdoor unit and a valve assembly; the indoor unit comprising: a compressor, a first control valve, a first indoor heat exchanger and a second indoor heat exchanger; the valve assembly being respectively connected with an exhaust outlet and a suction inlet of the compressor, a first end of the second indoor heat exchanger, and a first end of the outdoor unit, and a second end of the second indoor heat exchanger being connected with a second end of the outdoor unit; the valve assembly being configured to control a flow direction and on-off of refrigerant to form a refrigerant loop; and the first indoor heat exchanger having a first end connected with the exhaust outlet of the compressor and a second end connected with a second connection pipeline between the second end of the second indoor heat exchanger and the second end of the outdoor unit through a first connection pipeline, wherein the first control valve is provided in a pipeline between the first end of the first indoor heat exchanger and the exhaust outlet of the compressor.

In some embodiments, the outdoor unit comprises: at least two outdoor heat exchangers.

In some embodiments, the outdoor unit comprises: a first outdoor heat exchanger and a second outdoor heat exchanger; the valve assembly is respectively connected with the first end of the first outdoor heat exchanger and the first end of the second outdoor heat exchanger; and the second end of the first outdoor heat exchanger and the second end of the second outdoor heat exchanger are connected with the second end of the second indoor heat exchanger through the second connection pipeline.

In some embodiments, the valve assembly comprises: a first four-way valve and a second four-way valve; a first port of the first four-way valve and a first port of the second four-way valve are respectively connected with the exhaust outlet of the compressor, and a second port of the first four-way valve and a second port of the second four-way valve are respectively connected with the first end of the second indoor heat exchanger; a third port of the first four-way valve is connected with the first end of the second outdoor heat exchanger, and a third port of the second four-way valve is connected with the first end of the first outdoor heat exchanger; and a fourth port of the first four-way valve and a fourth port of the second four-way valve are connected with the suction inlet of the compressor.

In some embodiments, the valve assembly further comprises: a second control valve and a third control valve; the second control valve is provided in a pipeline between the second port of the first four-way valve and the first end of the second indoor heat exchanger; and the third control valve is provided in a pipeline between the second port of the second four-way valve and the first end of the second indoor heat exchanger.

In some embodiments, the outdoor unit comprises: a liquid storage tank; the second end of the first outdoor heat exchanger and the second end of the second outdoor heat exchanger are respectively connected with a first end of the liquid storage tank; a third throttle means is provided in a pipeline between the second end of the first outdoor heat exchanger and the first end of the liquid storage tank, and a fourth throttle means is provided in a pipeline between the second end of the second outdoor heat exchanger and the first end of the liquid storage tank; and a second end of the liquid storage tank is connected with the second connection pipeline.

In some embodiments, the indoor unit comprises: a fifth throttle means; and the fifth throttle means is provided in a third connection pipeline between the suction inlet of the compressor and the second end of the first indoor heat exchanger.

In some embodiments, the indoor unit comprises: two sixth throttle means; one sixth throttle means having a first end connected with the third connection pipeline and a second end connected with a pipeline located between the second port of the first four-way valve and the second control valve; the other sixth throttle means having a first end connected with the third connection pipeline and a second end connected with a pipeline located between the second port of the second four-way valve and the third control valve.

In some embodiments, stop valves are respectively provided in a pipeline between the third port of the first four-way valve and the first end of the second outdoor heat exchanger and a pipeline between the third port of the second four-way valve and the first end of the first outdoor heat exchanger; and a stop valve is provided in the second connection pipeline.

In some embodiments, the outdoor unit comprises: a first outdoor fan system and a second outdoor fan system, wherein the first outdoor fan system and the first outdoor heat exchanger are located in a first air duct, and the second outdoor fan system and the second outdoor heat exchanger are located in a second air duct.

In some embodiments, the indoor unit comprises: an indoor fan system; the indoor fan system, the first indoor heat exchanger and the second indoor heat exchanger being located in one same air duct, wherein indoor return air generated by the indoor fan system sequentially passes through the second indoor heat exchanger and the first indoor heat exchanger, or sequentially passes through the first indoor heat exchanger and the second indoor heat exchanger.

In some embodiments, a first throttle means is provided in the first connection pipeline, and a second throttle means is provided in the second connection pipeline.

According to a second aspect of the present disclosure, there is provided a control method of a heat pump system, applied to control the heat pump system as described above, comprising: determining an operating mode of the heat pump system; and controlling actions of the valve assembly in the heat pump system and the first control valve of the indoor unit according to a preset control strategy and based on the operating mode.

In some embodiments, when the operating mode is a dehumidifying-reheating mode or a first heating mode, the action of the first control valve is controlled such that the first indoor heat exchanger of the indoor unit is used for reheating air; and when the operating mode is a refrigerating/dehumidifying mode, a defrosting mode or a second heating mode, the action of the first control valve is controlled such that the first indoor heat exchanger stops reheating the air.

According to a third aspect of the present disclosure, there is provided a control method of a heat pump system, applied to control the heat pump system as described above, comprising: determining an operating mode of the heat pump system; and controlling actions of the first four-way valve, the second four-way valve, the first control valve, the second control valve and the third control valve in the heat pump system according to a preset control strategy and based on the operating mode.

In some embodiments, the operating mode comprises: at least one of a refrigerating/dehumidifying mode, a first heating mode, a second heating mode, a first dehumidifying-reheating mode, a second dehumidifying-reheating mode, a third dehumidifying-reheating mode, a first defrosting mode, or a second defrosting mode.

In some embodiments, when the operating mode is the refrigerating/dehumidifying mode, the first four-way valve is controlled to have the first port connected with the third port and the second port connected with the fourth port; the second four-way valve is controlled to have the first port connected with the third port and the second port connected with the fourth port; and the first control valve is controlled to be in an off state, and the second control valve and the third control valve are controlled to be in an on state;

when the operating mode is the first dehumidifying-reheating mode, controlling the first four-way valve to have the first port connected with the third port and the second port connected with the fourth port; controlling the second four-way valve to have the first port connected with the third port and the second port connected with the fourth port; and controlling the first control valve, the second control valve and the third control valve to be in the on state;

when the operating mode is the second dehumidifying-reheating mode, controlling the first four-way valve to have the first port connected with the second port and the third port connected with the fourth port; controlling the second four-way valve to have the first port connected with the third port and the second port connected with the fourth port; and controlling the first control valve and the third control valve to be in the on state, and controlling the second control valve to be in the off state;

when the operating mode is the third dehumidifying-reheating mode, controlling the first four-way valve to have the first port connected with the third port and the second port connected with the fourth port; controlling the second four-way valve to have the first port connected with the second port and the third port connected with the fourth port; and controlling the first control valve and the second control valve to be in the on state, and controlling the third control valve to be in the off state;

when the operating mode is the first heating mode, controlling the first four-way valve to have the first port connected with the second port and the third port connected with the fourth port;

controlling the second four-way valve to have the first port connected with the second port and the third port connected with the fourth port; and controlling the first control valve, the second control valve and the third control valve to be in the on state;

when the operating mode is the second heating mode, controlling the first four-way valve to have the first port connected with the second port and the third port connected with the fourth port; controlling the second four-way valve to have the first port connected with the second port and the third port connected with the fourth port; and controlling the first control valve to be in the off state, and controlling the second control valve and the third control valve to be in the on state;

when the operating mode is the first defrosting mode, controlling the first four-way valve to have the first port connected with the third port and the second port connected with the fourth port; controlling the second four-way valve to have the first port connected with the second port and the third port connected with the fourth port; and controlling the first control valve and the second control valve to be in the off state, and controlling the third control valve to be in the on state; or when the operating mode is the second defrosting mode, controlling the first four-way valve to have the first port connected with the second port and the third port connected with the fourth port; controlling the second four-way valve to have the first port connected with the third port and the second port connected with the fourth port; and controlling the first control valve and the third control valve to be in the off state, and controlling the second control valve to be in the on state.

According to a fourth aspect of the present disclosure, there is provided a control apparatus of a heat pump system, comprising: a memory; and a processor coupled to the memory, the processor being configured to perform, based on instructions stored in the memory, the method as described above.

According to a fifth aspect of the present disclosure, there is provided an air conditioning device, comprising: the heat pump system as described above, and the control apparatus of the heat pump system as described above.

According to a sixth aspect of the present disclosure, there is provided a computer-readable storage medium having therein stored computer instructions which, when executed by a processor, perform the method as described above.

BRIEF DESCRIPTION OF THE DRAWINGS

In order to more clearly illustrate embodiments of the present disclosure or technical solutions in related arts, the drawings that need to be used in the description of the embodiments or related arts will be briefly described below, it is obvious that the drawings in the description below are only some embodiments of the present disclosure, and for those skilled in the art, other drawings can also be obtained according to the drawings without paying creative labor.

DESCRIPTION OF THE INVENTION

In order to make technical problems to be solved by the present disclosure, technical solutions and advantageous effects more clearly understood, the present disclosure is further described in detail below with reference to the accompanying drawings and embodiments. It should be understood that the specific embodiments described herein are only used to explain the present disclosure, and not to limit the present disclosure.

Thus, one feature indicated in this specification will serve to describe one of features of one embodiment of the present disclosure, rather than imply that every embodiment of the present disclosure must have the described feature. Furthermore, it should be noted that this specification describes many features. Although some features can be combined to show a possible system design, these features can also be used in other combinations not explicitly described. Thus, the described combinations are not intended to be limiting unless otherwise specified.

The principles and structures of the present disclosure will be described in detail below with reference to the drawings and embodiments.

The inventors of the present disclosure have found that, in the related arts described above exist the following problems: if an electric heating system is used for heating, this will cause more power consumption of the thermostat and humidistat and less energy efficiency.

In view of this, the present disclosure provides a heat pump system, a control method and apparatus thereof, an air conditioning device, and a storage medium. The heat pump system is used to realize functions such as dehumidifying-reheating, heating-warming, can realize heat recovery dehumidifying-reheating and makes air supply temperature adjustable, without the need of an electric heating system, can reduce energy consumption and improve energy saving performance; the use of double outdoor heat exchangers can realize asynchronous defrosting during which refrigerant entering an indoor heat exchanger is maintained in a high pressure state, and can maintain indoor heat output to reduce a great fluctuation of indoor temperature caused by no heating of the indoor heat exchanger in the defrosting, thereby improving use feeling of a user.

Figure 1:
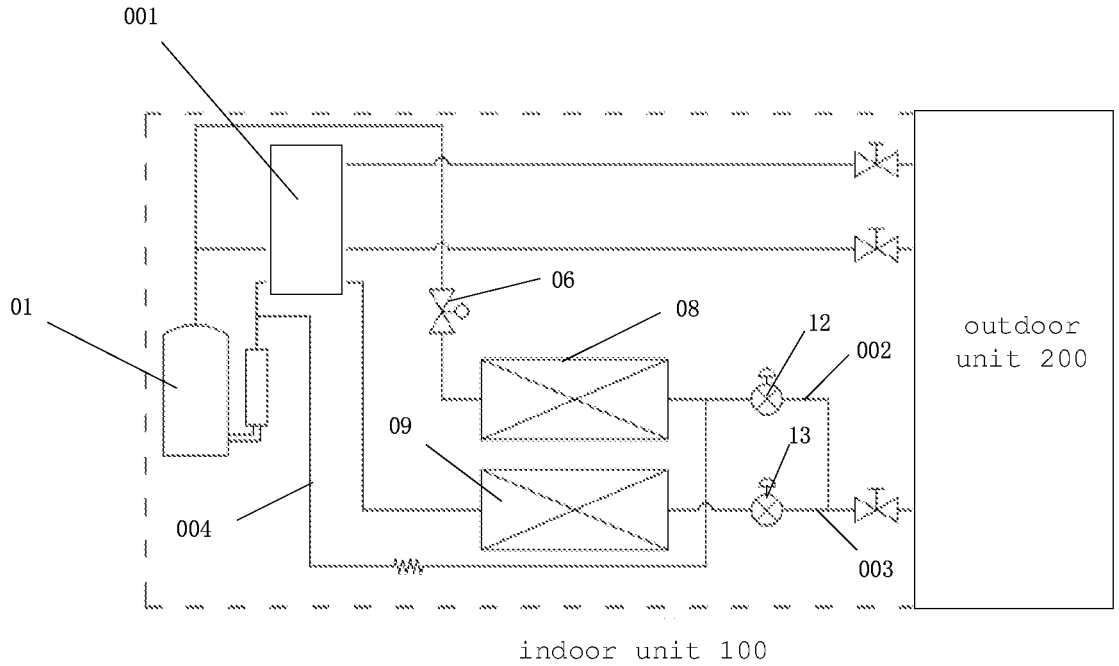
FIG. 1 is a schematic structural diagram of a heat pump system according to some embodiments of the present disclosure.

In some embodiments, as shown in FIG. 1, the present disclosure provides a heat pump system comprising an indoor unit 100, an outdoor unit 200, and a valve assembly 001. The indoor unit comprises a compressor 01, a first control valve 06, a first indoor heat exchanger 08, and a second indoor heat exchanger 09.

The valve assembly 001 is respectively connected with an exhaust outlet and a suction inlet of the compressor 01, a first end of the second indoor heat exchanger 09, and a first end of the outdoor unit 200, and a second end of the second indoor heat exchanger 09 is connected with a second end of the outdoor unit 200. The valve assembly 001 can be realized in various ways, and the valve assembly 001 is configured to control a flow direction and on-off of refrigerant to form a refrigerant loop, and functions such as refrigerating, heating can be realized by controlling an action of the valve assembly 001.

The first indoor heat exchanger 08 has a first end connected with the exhaust outlet of the compressor 01 and a second end connected with a second connection pipeline 003 between the second end of the second indoor heat exchanger 09 and the second end of the outdoor unit 200 through a first connection pipeline 002, to be connected into the refrigerant loop. The first control valve 06 is provided in a pipeline between the first end of the first indoor heat exchanger 08 and the exhaust outlet of the compressor 01.

In the first connection pipeline 002 is provided a first throttle means 12, and in the second connection pipeline 003 is provided a second throttle means 13. The first throttle means 12 and the second throttle means 13 can be electronic expansion valves or the like. The first indoor heat exchanger 08 and the second indoor heat exchanger 09 can be various heat exchangers, and the first control valve 06 can be various solenoid valves, ball valves, etc.

Air supplied by the heat pump system under a dehumidifying function is generally cooler, so that reheating air supply is needed. In the prior art, the supplied air is generally heated in a way of electric heating. By controlling on or off of the first control valve 06, refrigerant output from the exhaust outlet of the compressor 01 can enter the first indoor heat exchanger 08, and refrigerant output from the first indoor heat exchanger 08 enters the refrigerant loop of the heat pump system through the first connection pipeline 002. While the basic function of the heat pump system is kept, when indoor humidity is greater than set humidity and indoor temperature is less than or equal to set temperature, in order to avoid temperature overshoot, the reheating air supply is performed by using heat of condensation generated by the first indoor heat exchanger 08. By using the heat of condensation generated by the first indoor heat exchanger 08 to reheat the air, the air reheating function in the dehumidifying is realized, so that the use of the heat of condensation generated by the first indoor heat exchanger 08 to realize the dehumidifying-reheating function, compared with the electric heating system, is more economical and energy-saving.

Figure 2:
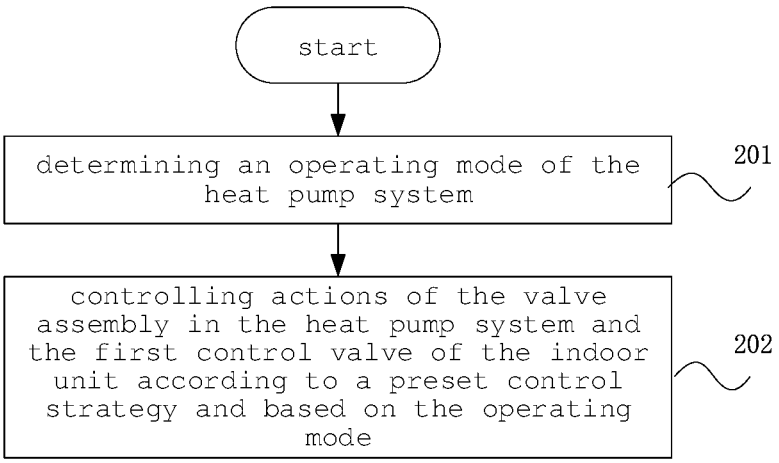
FIG. 2 is a schematic flow diagram of a control method of a heat pump system according to some embodiments of the present disclosure.

FIG. 2 is a schematic flow diagram of a control method of a heat pump system according to some embodiments of the present disclosure, as shown in FIG. 2:

step 201, determining an operating mode of the heat pump system.

Step 202, controlling actions of the valve assembly in the heat pump system and the first control valve of the indoor unit according to a preset control strategy and based on the operating mode.

The operating mode comprises at least one of a refrigerating/dehumidifying mode, a first heating mode, a second heating mode, a dehumidifying-reheating mode, a defrosting mode, or the like. The control strategy can be set according to a design requirement, and the actions of the valve assembly 001 in the heat pump system and the first control valve 06 of the indoor unit are controlled according to the control strategy and based on the operating mode, to realize the functions of the refrigerating/dehumidifying mode, the first heating mode, the second heating mode, the dehumidifying-reheating mode, the defrosting mode, and the like.

In some embodiments, when the operating mode is the dehumidifying-reheating mode and the first heating mode, the action (on) of the first control valve 06 is controlled so that the first indoor heat exchanger 08 of the indoor unit is used for reheating air. When the operating mode is the refrigerating/dehumidifying mode, the defrosting mode, and the second heating mode, the action (off) of the first control valve 06 is controlled so that the first indoor heat exchanger 08 stops operating.

In the dehumidifying-reheating mode, the reheating air supply can be performed by using the heat of condensation of the first indoor heat exchanger 08, or in the first heating mode, heating can also be performed by using the heat of condensation of the first indoor heat exchanger 08. In the refrigerating/dehumidifying mode, the defrosting mode, the second heating mode, and the like, refrigerant output from the compressor 01 does not enter the first indoor heat exchanger 08, the first indoor heat exchanger 08 stops operating, and no heat of condensation is generated.

Figure 3:
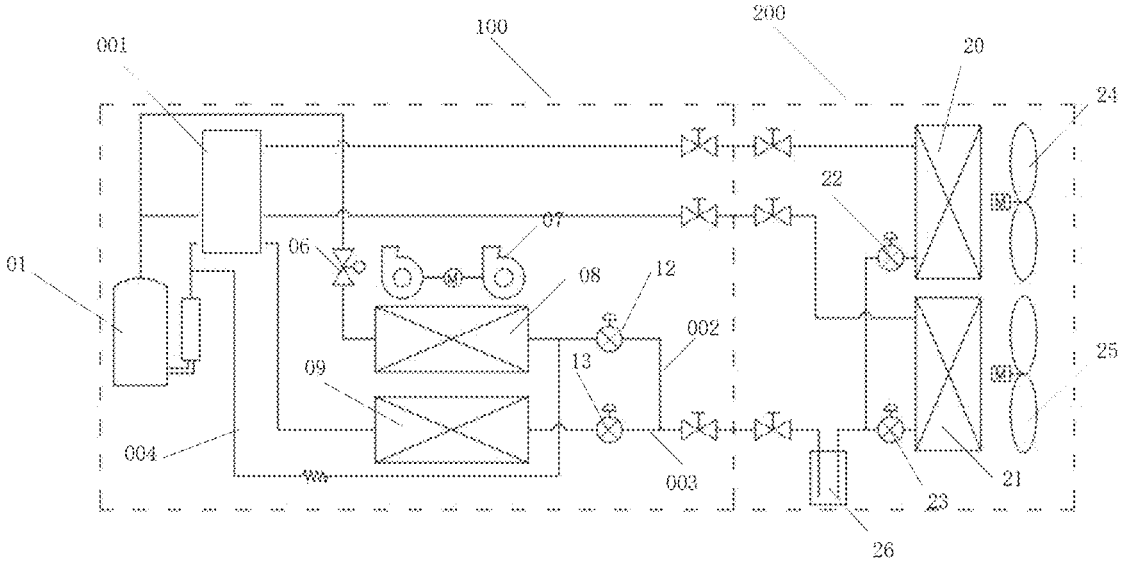
FIG. 3 is a schematic structural diagram of a heat pump system according other embodiments of to the present disclosure.

In some embodiments, the outdoor unit 200 comprises at least two outdoor heat exchangers, that is, two or more outdoor heat exchangers, which will be described below by taking two outdoor heat exchangers as an example. As shown in FIG. 3, the outdoor unit 200 comprises first and second outdoor heat exchangers 20 and 21 and a liquid storage tank 26. The valve assembly 001 is connected with a first end of the first outdoor heat exchanger 20 and a first end of the second outdoor heat exchanger 21, respectively. A second end of the first outdoor heat exchanger 20 and a second end of the second outdoor heat exchanger 21 are connected with the second end of the second indoor heat exchanger 09 through a second connection pipeline 003. The first and second outdoor heat exchangers 20 and 21 can be various heat exchangers.

The outdoor unit 200 comprises a first outdoor fan system 24 and a second outdoor fan system 25, the first outdoor fan system 24 and the first outdoor heat exchanger 20 being located in a first air duct, the second outdoor fan system 25 and the second outdoor heat exchanger 21 being located in a second air duct. The first air duct and the second air duct are independent of each other.

The indoor unit 100 comprises an indoor fan system 07. The indoor fan system 07, the first indoor heat exchanger 08 and the second indoor heat exchanger 09 are located in one same air duct, and indoor return air generated by the indoor fan system 07 sequentially passes through the second indoor heat exchanger 09 and the first indoor heat exchanger 07.

Figure 4:
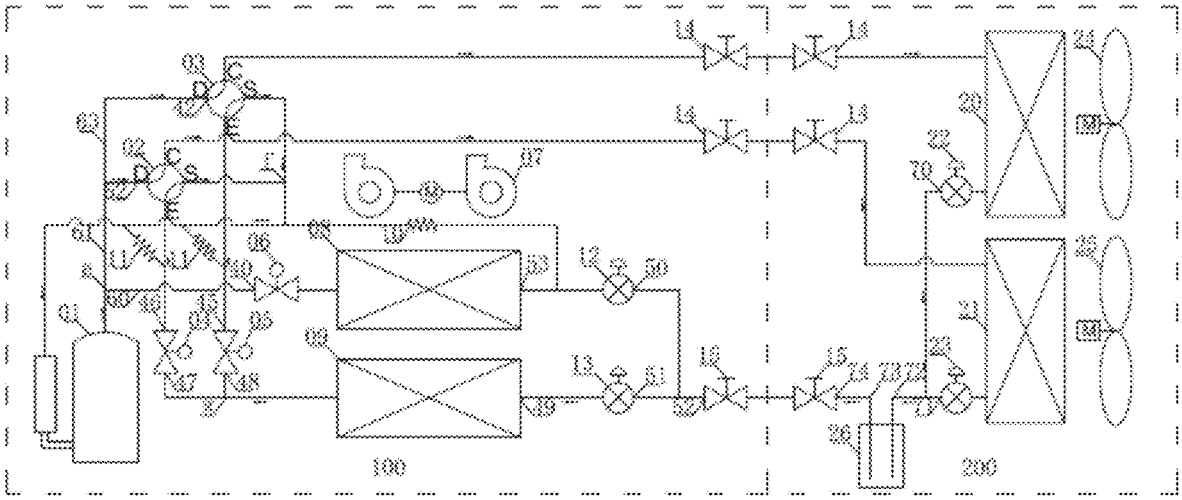
FIG. 4 is a schematic diagram of a refrigerant flow path of a heat pump system in a refrigerating/dehumidifying mode according to an embodiment of the present disclosure.

In some embodiments, as shown in FIG. 4, the valve assembly comprises a first four-way valve 02 and a second four-way valve 03. A first port D1 of the first four-way valve 02 and a first port D2 of the second four-way valve 03 are respectively connected with the exhaust outlet of the compressor 01, and a second port E1 of the first four-way valve 02 and a second port E2 of the second four-way valve 03 are respectively connected with the first end of the second indoor heat exchanger 09.

A third port C1 of the first four-way valve 02 is connected with the first end of the second outdoor heat exchanger 21, and a third port C2 of the second four-way valve 03 is connected with the first end of the first outdoor heat exchanger 20; and a fourth port S1 of the first four-way valve 02 and a fourth port S2 of the second four-way valve 03 are respectively connected with the suction inlet of the compressor 01.

The valve assembly further comprises a second control valve 04 and a third control valve 05. The second control valve 04 and the third control valve 05 can be solenoid valves, ball valves, etc. The second control valve 04 is provided in a pipeline between the second port E1 of the first four-way valve 02 and the first end of the second indoor heat exchanger 09. The third control valve 05 is provided in a pipeline between the second port E2 of the second four-way valve 03 and the first end of the second indoor heat exchanger 09. Stop valves 14 are provided in a pipeline between the third port C1 of the first four-way valve 02 and the first end of the second outdoor heat exchanger 21 and a pipeline between the third port C2 of the second four-way valve 03 and the first end of the first outdoor heat exchanger 20, respectively. A stop valve 15 is provided in the second connection pipeline 003.

As shown in FIG. 4, refrigerant discharged from the exhaust outlet of the compressor 01 is divided into a first branch 60 and a second branch 61, the first branch 60 being connected with the first end 40 of the first control valve 06, the second branch 61 being divided into two paths, a first path 62 being connected with the first port D1 of the first four-way valve 02, the second path 63 being connected with the first port D2 of the second four-way valve 03. The first control valve 06, the first indoor heat exchanger 08 and the first throttle means 12 are connected in series; and the suction inlet of the compressor 01 is connected with the fourth port S1 of the first four-way valve 02 and the fourth port S2 of the second four-way valve 03, respectively.

The second port E1 of the first four-way valve 02 is connected with a first end 46 of the second control valve 04, the second port E2 of the second four-way valve 03 is connected with a first end 45 of the third control valve 05, a second end 47 of the second control valve 04 and a second end 48 of the third control valve 05 are connected with the first end of the second indoor heat exchanger 09, a connection point between the second end 48 of the third control valve 05 and the second indoor heat exchanger 09 is g, the second indoor heat exchanger 09 and the second throttle means 13 are connected in series, and a second port 50 of the first throttle means 12 and a second port 51 of the second throttle means 13 are connected with a port 52 of the stop valve 15.

When the first four-way valve 02 and the second four-way valve 03 are powered down, the first four-way valve 02 and the second four-way valve 03 have the first ports D1 and D2 respectively connected with the third ports C1 and C2 and the fourth ports S1 and S2 respectively connected with the second ports E1 and E2; and when the first four-way valve 02 and the second four-way valve 03 are powered on, the first four-way valve 02 and the second four-way valve 03 have the first ports D1 and D2 respectively connected with the second ports E1 and E2 and the fourth ports S1 and S2 respectively connected with the third ports C1 and C2. The first control valve 06, the second control valve 04, and the third control valve 05 are in an on state when powered on, and are in an off state when powered down.

The second end of the first outdoor heat exchanger 20 and the second end of the second outdoor heat exchanger 21 are respectively connected with a first end of the liquid storage tank 26; in a pipeline between the second end of the first outdoor heat exchanger 20 and the first end of the liquid storage tank 26 is provided the third throttle means 22, and in a pipeline between the second end of the second outdoor heat exchanger 21 and the first end of the liquid storage tank 26 is provided the fourth throttle means 23; and a second end of the liquid storage tank 26 is connected with the second connection pipeline 003. The third and fourth throttle means 22 and 23 can be electronic expansion valves or the like.

The first outdoor heat exchanger 20 and the third throttle means 22 are connected in series, the second outdoor heat exchanger 21 and the fourth throttle means 23 are connected in series, a port 70 of the third throttle means 22 and a port 71 of the fourth throttle means 23 are connected with the first end 72 of the liquid storage tank 26, and a second end 73 of the liquid storage tank 26 is connected with a port 74 of the stop valve 15.

In a third connection pipeline 004 between the suction inlet of the compressor 01 and the second end of the first indoor heat exchanger 08 is provided a fifth throttle means 10, and the fifth throttle means 10 can be a capillary or the like. The fifth throttle means 10 is connected with the second port 53 of the first indoor heat exchanger 08 and the suction inlet of the compressor 01, so that the first indoor heat exchanger 08 can be switched to low pressure in the refrigerating/dehumidifying mode, and meanwhile, liquid refrigerant in the first indoor heat exchanger is discharged, to avoid a problem of liquid storage in the first indoor heat exchanger 08.

Two sixth throttle means 11 are provided, wherein the sixth throttle means 11 can be a capillary or the like. One sixth throttle means 11 has a first end connected with the third connection pipeline 004 and a second end connected with a pipeline between the second port E1 of the first four-way valve 02 and the second control valve 04; and the other sixth throttle means 11 has a first end connected with the third connection pipeline 004 and a second end connected with a pipeline between the second port E2 of the second four-way valve 03 and the third control valve 05.

The one sixth throttle means 11, connected with the port 46 of the second control valve 04 and the suction inlet of the compressor 01, can discharge liquid refrigerant between the second port E1 of the first four-way valve 02 and the port 46 of the second control valve 04 after the second control valve 04 is powered down (closed) in the second dehumidifying-reheating mode, to avoid a liquid hammer problem when the first four-way valve 02 is reversed.

The other sixth throttle means 11, connected with the port 45 of the third control valve 05 and the suction inlet of the compressor 01, can discharge liquid refrigerant between the second port E2 of the second four-way valve 03 and the port 45 of the third control valve 05 after the third control valve 05 is powered down (closed) in the third dehumidifying-reheating mode, to avoid a liquid hammer problem when the second four-way valve 03 is reversed.

Figure 5:
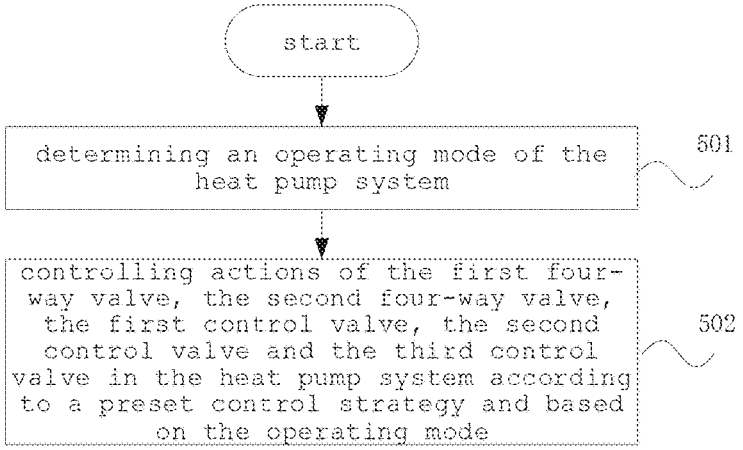
FIG. 5 is a schematic flow diagram of a control method of a heat pump system according to other embodiments of the present disclosure.

FIG. 5 is a schematic flow diagram of a control method of a heat pump system according to other embodiments of the present disclosure, as shown in FIG. 5:

step 501, determining an operating mode of the heat pump system. The operating mode comprises at least one of a refrigerating/dehumidifying mode, a first heating mode, a second heating mode, a first dehumidifying-reheating mode, a second dehumidifying-reheating mode, a third dehumidifying-reheating mode, a first defrosting mode, a second defrosting mode, or the like.

Step 502, controlling actions of the first four-way valve 02, the second four-way valve 03, the first control valve 06, the second control valve 04 and the third control valve 05 in the heat pump system according to a preset control strategy and based on the operating mode. When the first control valve 06 is in the off state, the first throttle means 12 is controlled to be in a closed state.

In some embodiments, when the operating mode is the refrigerating/dehumidification mode, the first four-way valve 02 is controlled to have the first port D1 connected with the third port C1 and the second port E1 connected with the fourth port S1; the second four-way valve 03 is controlled to have the first port D2 connected with the third port C2 and the second port E2 connected with the fourth port S2; and the first control valve 06 is controlled to be in the off state, and the second control valve 04 and the third control valve 05 are controlled to be in the on state.

As shown in FIG. 4, in the refrigerating/dehumidifying mode, refrigerant discharged from the exhaust outlet of the compressor 01 does not pass through the first indoor heat exchanger 08, and the first indoor heat exchanger 08 does not operate. One path of refrigerant discharged from the exhaust outlet of the compressor 01 passes through the first four-way valve 02, the stop valve 14, the second outdoor heat exchanger 21, the fourth throttle means 23, the liquid storage tank 26, the stop valve 15, the second throttle means 13, the second indoor heat exchanger 09, the first four-way valve 02 and the second four-way valve 03, and returns to the suction inlet of the compressor 01.

The other path of refrigerant discharged from the exhaust outlet of the compressor 01 passed through the second four-way valve 03, the stop valve 14, the first outdoor heat exchanger 20, the third throttle means 22, the liquid storage tank 26, the stop valve 15, the second throttle means 13, the second indoor heat exchanger 09, the first four-way valve 02 and the second four-way valve 03, and returns to the suction inlet of the compressor 01.

In some embodiments, when the operating mode is the first dehumidifying-reheating mode, the first four-way valve 02 is controlled to have the first port D1 connected with the third port C1 and the second port E1 connected with the fourth port S1; the second four-way valve 03 is controlled to have the first port D2 connected with the third port C2 and the second port E2 connected with the fourth port S2; and the first control valve 06, the second control valve 04 and the third control valve 05 are controlled to be in the on state.

Figure 6:
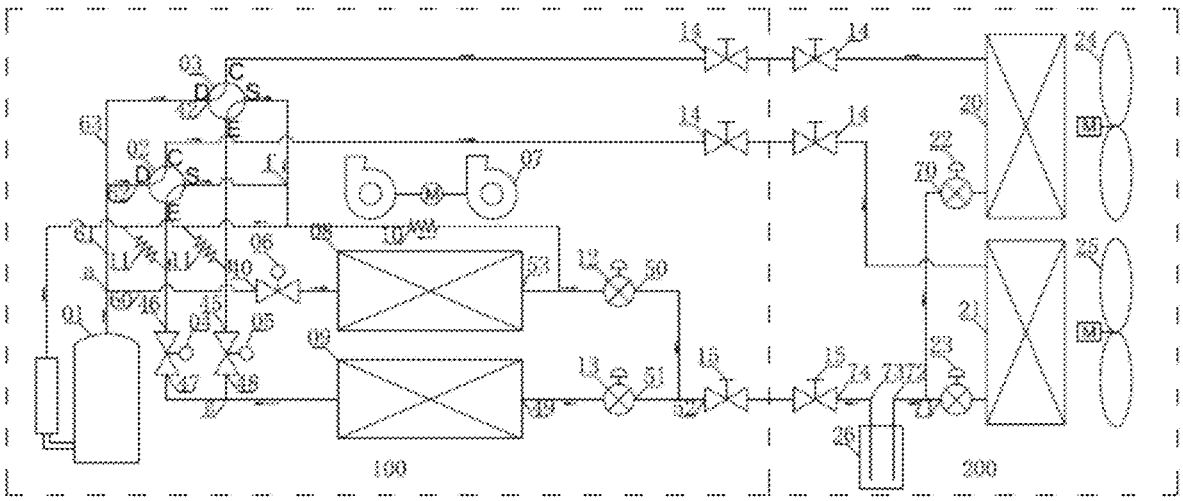
FIG. 6 is a schematic diagram of a refrigerant flow path of a heat pump system in a first dehumidifying-reheating mode according to an embodiment of the present disclosure.

As shown in FIG. 6, in the first dehumidifying-reheating mode, a first path of refrigerant discharged from the exhaust outlet of the compressor 01, after passing through the first indoor heat exchanger 08, passes through the first throttle means 12 and the second throttle means 13 and enters the second indoor heat exchanger 09. The first indoor heat exchanger 08 generates heat of condensation.

A second path of refrigerant discharged from the exhaust outlet of the compressor 01 passes through the first four-way valve 02, the stop valve 14, the second outdoor heat exchanger 21, the fourth throttle means 23, the liquid storage tank 26, the stop valve 15, the second throttle means 13, the second indoor heat exchanger 09, the first four-way valve 02 and the second four-way valve 03, and returns to the suction inlet of the compressor 01.

A third path of refrigerant discharged from the exhaust outlet of the compressor 01 passes through the second four-way valve 03, the stop valve 14, the first outdoor heat exchanger 20, the third throttle means 22, the liquid storage tank 26, the stop valve 15, the second throttle means 13, the second indoor heat exchanger 09, the first four-way valve 02 and the second four-way valve 03, and returns to the suction inlet of the compressor 01.

In some embodiments, when the operating mode is the second dehumidifying-reheating mode, the first four-way valve 02 is controlled to have the first port D1 connected with the second port E1 and the third port C1 connected with the fourth port S1; and the first control valve 06 and the third control valve 05 are controlled to be in the on state, and the second control valve 04 is controlled to be in the off state.

Figure 7:
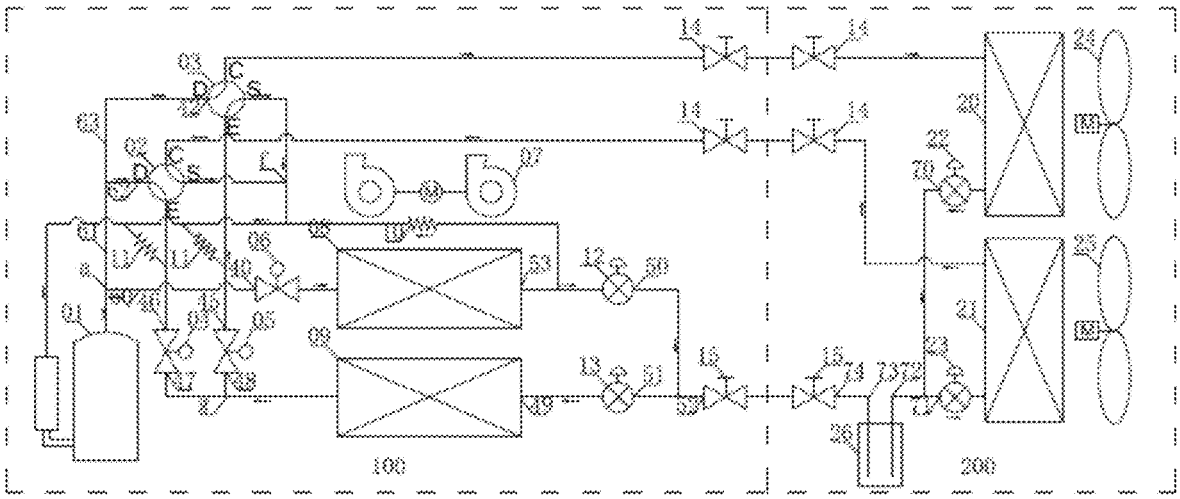
FIG. 7 is a schematic diagram of a refrigerant flow path of a heat pump system in a second dehumidifying-reheating mode according to an embodiment of the present disclosure.

As shown in FIG. 7, in the second dehumidifying-reheating mode, a first path of refrigerant discharged from the exhaust outlet of the compressor 01, after passing through the first indoor heat exchanger 08, passes through the first throttle means 12 and the second throttle means 13, and enters the second indoor heat exchanger 09. The first indoor heat exchanger 08 generates heat of condensation.

A second path of refrigerant discharged from the exhaust outlet of the compressor 01 passes through the second four-way valve 03, the stop valve 14, the first outdoor heat exchanger 20, the third throttle means 22, and the liquid storage tank 26; and part of the refrigerant output through the third throttle means 22 can pass through the fourth throttle means 23, the second outdoor heat exchanger 21, the stop valve 14, and the first four-way valve 02, and return to the suction inlet of the compressor 01.

Figure 8:
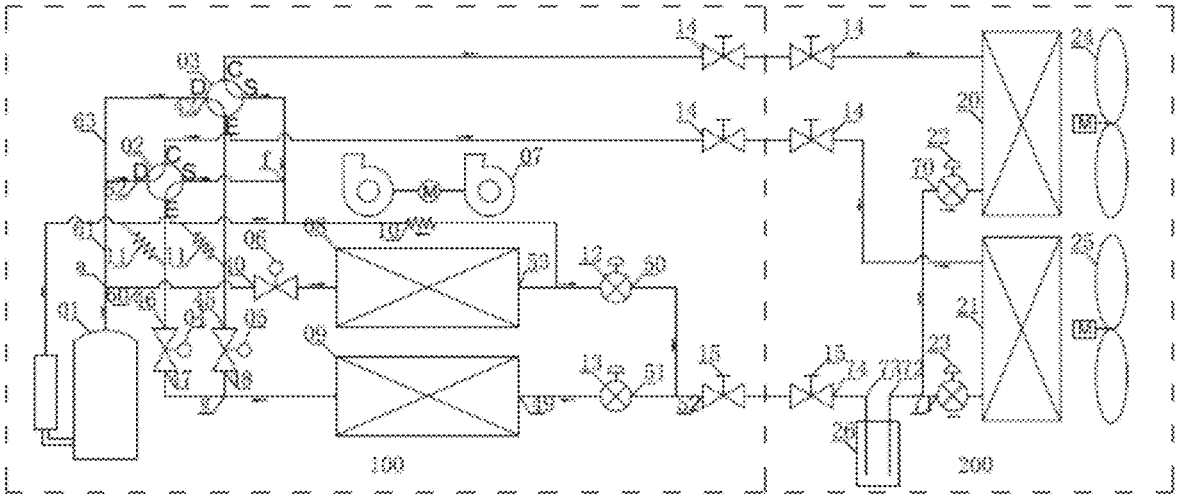
FIG. 8 is a schematic diagram of a refrigerant flow path of a heat pump system in a third dehumidifying-reheating mode according to an embodiment of the present disclosure.

In some embodiments, as shown in FIG. 8, when the operating mode is the third dehumidifying-reheating mode, the first four-way valve 02 is controlled to have the first port D1 connected with the third port C1 and the second port E1 connected with the fourth port S1; the second four-way valve 03 is controlled to have the first port D2 connected with the second port E2 and the third port C2 connected with the fourth port S2; and the first control valve 06 and the second control valve 04 are controlled to be in the on state, and the third control valve 05 is controlled to be in the off state.

As shown in FIG. 8, in the third dehumidifying-reheating mode, a first path of refrigerant discharged from the exhaust outlet of the compressor 01, after passing through the first indoor heat exchanger 08, passes through the first throttle means 12 and the second throttle means 13, and enters the second indoor heat exchanger 09. The first indoor heat exchanger 08 generates heat of condensation.

A second path of refrigerant discharged from the exhaust outlet of the compressor 01 passes through the first four-way valve 02, the stop valve 14, the second outdoor heat exchanger 21, the fourth throttle means 23, and the liquid storage tank 26; and part of the refrigerant output from the fourth throttle means 23 can pass through the third throttle means 22, the first outdoor heat exchanger 20, and the second four-way valve 03, and return to the suction inlet of the compressor 01.

In some embodiments, dehumidifying-reheating is achieved by means of cooperation of the first indoor heat exchanger 08 and the second indoor heat exchanger 09, wherein the second indoor heat exchanger 09 is responsible for dehumidifying and cooling, since indoor humidity load and cold load are not equal and the output of the heat pump system is regulated according to the greater of the humidity load and the cold load, when the humidity load is greater than the cold load, this will cause indoor temperature overshot (the current indoor environment temperature is lower than the set temperature), and at this time, the first indoor heat exchanger 08 intervenes to regulate the cold load, namely, to compensate for excessive refrigeration output, so that the indoor temperature matches the set value.

In the heating process, the humidity load is generally a humidification load, and the thermostat and humidistat has a dedicated humidifier, which does not relate to the action of the indoor heat exchanger; a heat load in winter is mainly realized by the cooperation of the first indoor heat exchanger 08 and the second indoor heat exchanger 09, and there are three states in total, which can be, according to different heat load requirements, the first indoor heat exchanger 08 operating, the second indoor heat exchanger 09 operating, and the first indoor heat exchanger 08 and the second indoor heat exchanger 09 jointly operating.

In some embodiments, when the operating mode is the first heating mode, the first four-way valve 02 is controlled to have the first port D1 connected with the second port E1 and the third port C1 connected with the fourth port S1; the second four-way valve 03 is controlled to have the first port D2 connected with the second port E2 and the third port C2 connected with the fourth port S2; and the first control valve 06, the second control valve 04 and the third control valve 05 are controlled to be in the on state.

Figure 9:
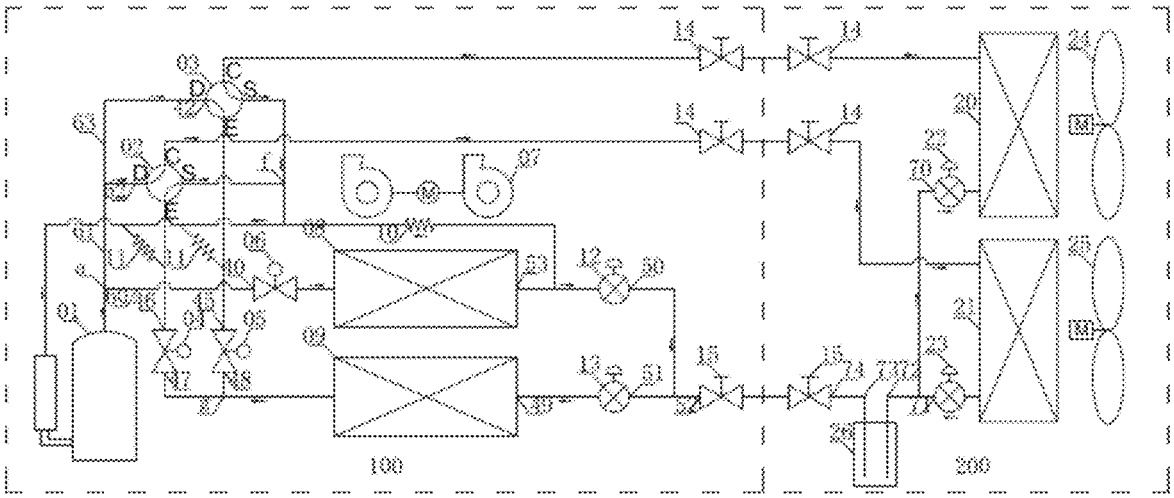
FIG. 9 is a schematic diagram of a refrigerant flow path of a heat pump system in a first heating mode according to an embodiment of the present disclosure.

As shown in FIG. 9, in the first heating mode, a first path of refrigerant discharged from the exhaust outlet of the compressor 01, after passing through the first indoor heat exchanger 08, passes through the first throttle means 12 and the stop valve 15 and enters the liquid storage tank 26. The first indoor heat exchanger 08 generates heat of condensation.

A second path of refrigerant discharged from the exhaust outlet of the compressor 01 passes through the first four-way valve 02, the second indoor heat exchanger 09, the second throttle means 13 and the stop valve 15, and enters the liquid storage tank 26. A third path of refrigerant discharged from the exhaust outlet of the compressor 01 passes through the second four-way valve 03, the second indoor heat exchanger 09, the second throttle means 13 and the stop valve 15, and enters the liquid storage tank 26.

One path of refrigerant output from the liquid storage tank 26 passes through the fourth throttle means 23, the second outdoor heat exchanger 21, the stop valve 14 and the first four-way valve 02, and returns to the suction inlet of the compressor 01; and the other path of refrigerant output from the liquid storage tank 26 passes through the third throttle means 22, the first outdoor heat exchanger 20, the stop valve 14 and the second four-way valve 03, and returns to the suction inlet of the compressor 01.

In some embodiments, when the operating mode is the second heating mode, the first four-way valve 02 is controlled to have the first port D1 connected with the second port E1 and the third port C1 connected with the fourth port S1; the second four-way valve 03 is controlled to have the first port D2 connected with the second port E2 and the third port C2 connected with the fourth port S2; and the first control valve 06 is controlled to be in the off state, and the second control valve 04 and the third control valve 05 are controlled to be in the on state.

Figure 10:
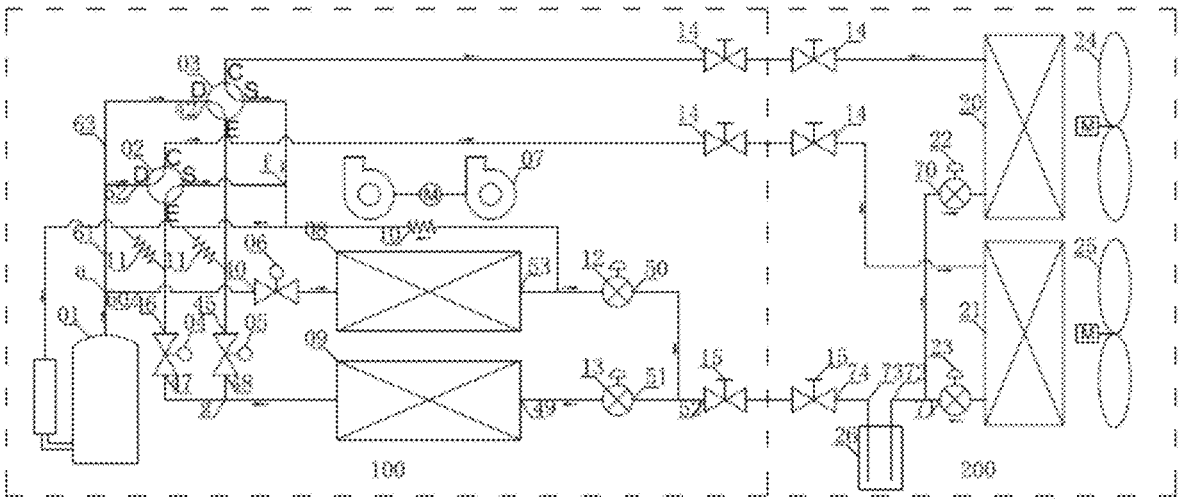
FIG. 10 is a schematic diagram of a refrigerant flow path of a heat pump system in a second heating mode according to an embodiment of the present disclosure.

As shown in FIG. 10, in the second heating mode, refrigerant discharged from the exhaust outlet of the compressor 01 does not pass through the first indoor heat exchanger 08, and the first indoor heat exchanger 08 does not operate. A second path of refrigerant discharged from the exhaust outlet of the compressor 01 passes through the first four-way valve 02, the second indoor heat exchanger 09, the second throttle means 13 and the stop valve 15, and enters the liquid storage tank 26. A third path of refrigerant discharged from the exhaust outlet of the compressor 01 passes through the second four-way valve 03, the second indoor heat exchanger 09, the second throttle means 13 and the stop valve 15, and enters the liquid storage tank 26.

One path of refrigerant output by the liquid storage tank 26 passes through the fourth throttle means 23, the second outdoor heat exchanger 21, the stop valve 14 and the first four-way valve 02, and returns to the suction inlet of the compressor 01; and the other path of refrigerant output from the liquid storage tank 26 passes through the third throttle means 22, the first outdoor heat exchanger 20, the stop valve 14 and the second four-way valve 03, and returns to the suction inlet of the compressor 01.

In some embodiments, when the operating mode is the first defrosting mode, the first four way valve 02 is controlled to have the first port D1 connected with the third port C1 and the second port E1 connected with the fourth port S1; the second four-way valve 03 is controlled to have the first port D2 connected with the second port E2 and the third port C2 connected with the fourth port S2; and the first control valve 06 and the second control valve 04 are controlled to be in the off state, and the third control valve 05 is controlled to be in the on state.

Figure 11:
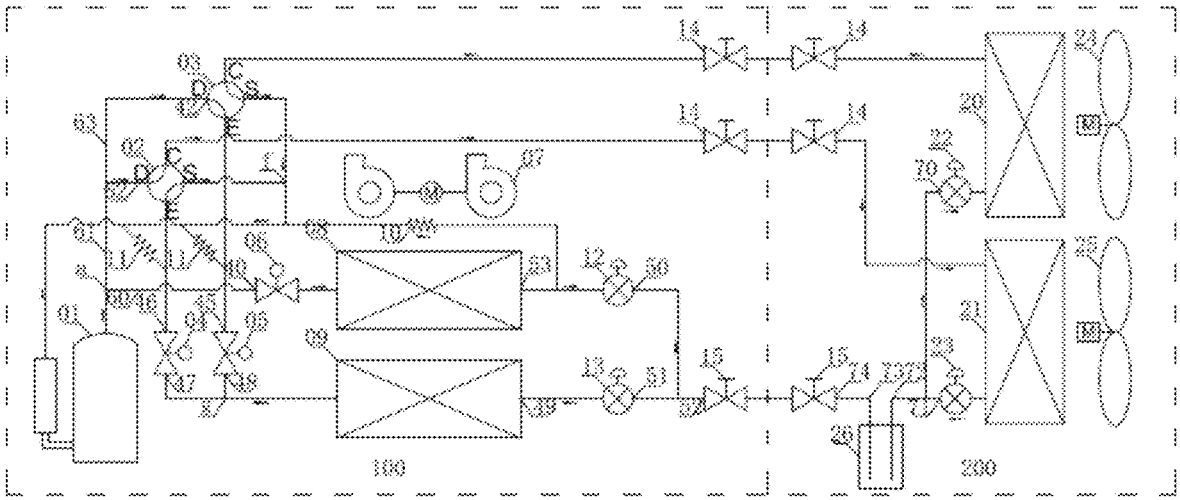
FIG. 11 is a schematic diagram of a refrigerant flow path of a heat pump system in a first defrosting mode according to an embodiment of the present disclosure.

As shown in FIG. 11, in the first defrosting mode, refrigerant discharged from the exhaust outlet of the compressor 01 does not pass through the first indoor heat exchanger 08, and the first indoor heat exchanger 08 does not operate.

A first path of refrigerant discharged from the exhaust outlet of the compressor 01, after passing through the first four-way valve 02, the stop valve 14, the second outdoor heat exchanger 21, and the fourth throttle means 23, passes through the third throttle means 22, the first outdoor heat exchanger 20, the stop valve 14, and the second four-way valve 03, and returns to the suction inlet of the compressor 01, to be subjected to defrosting. A second path of refrigerant discharged from the exhaust outlet of the compressor 01 passes through the second four-way valve 03, the second indoor heat exchanger 09, the second throttle means 13 and the stop valve 15, and enters the liquid storage tank 26. Refrigerant output from the liquid storage tank 26 passes through the third throttle means 22, the first outdoor heat exchanger 20, the stop valve 14 and the second four-way valve 03, and returns to the suction inlet of the compressor 01.

In some embodiments, when the operating mode is the second defrosting mode, the first four way valve 02 is controlled to have the first port D1 connected with the second port E1 and the third port C1 connected with the fourth port S1; the second four-way valve 03 is controlled to have the first port D2 connected with the third port C2 and the second port E2 connected with the fourth port S2; and the first control valve 06 and the third control valve 05 are controlled to be in the off state, and the second control valve 04 is controlled to be in the on state.

Figure 12:
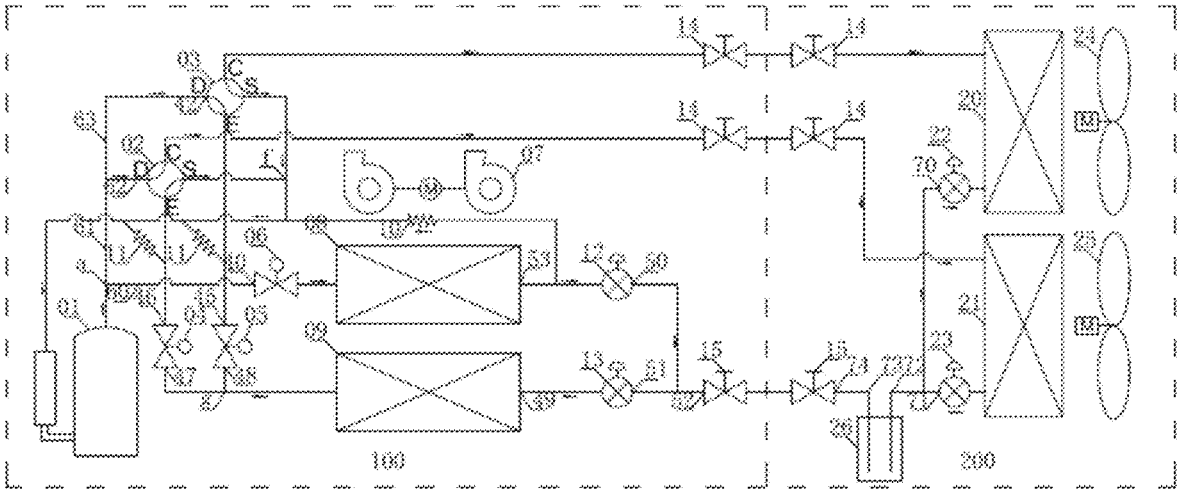
FIG. 12 is a schematic diagram of a refrigerant flow path of a heat pump system in a second defrosting mode according to an embodiment of the present disclosure.

As shown in FIG. 12, in the second defrosting mode, refrigerant discharged from the exhaust outlet of the compressor 01 does not pass through the first indoor heat exchanger 08, and the first indoor heat exchanger 08 does not operate. A first path of refrigerant discharged from the exhaust outlet of the compressor 01, after passing through the second four-way valve 03, the stop valve 14, the first outdoor heat exchanger 20, and the third throttle means 22, passes through the fourth throttle means 23, the second outdoor heat exchanger 21, the stop valve 14, and the first four-way valve 04, and returns to the suction inlet of the compressor 01, to be subjected to defrosting.

A second path of refrigerant discharged from the exhaust outlet of the compressor 01 passes through the first four-way valve 02, the second indoor heat exchanger 09, the second throttle means 13 and the stop valve 15, and enters the liquid storage tank 26. Refrigerant output from the liquid storage tank 26 passes through the fourth throttle means 23, the second outdoor heat exchanger 21, the stop valve 14, and the first four-way valve 04, and returns to the suction inlet of the compressor 01.

In some embodiments, when there is the cooling load or humidity load indoors, the system first enters the refrigerating/dehumidifying mode, the cooling load can be characterized by a function expression of a difference between the indoor environment temperature and the set temperature, and the humidity load can be characterized by a function expression of a difference between an indoor humidity content and a set humidity content. When the humidity load is greater than the cooling load, for example, the humidity content does not reach a set value, but the indoor temperature has already been less than the set value, the first dehumidifying-reheating mode will be entered.

In the first dehumidifying-reheating mode, if the humidity load has reached a preset value, but the heat load does not meet the preset value (the current indoor temperature is lower than preset temperature), a step count of the first throttle means 12 is increased, to increase a heat exchange quantity of the first indoor heat exchanger 08; if the heat exchange quantity of the first indoor heat exchanger 08 is maximum (the heat exchange quantities of the first outdoor heat exchanger 20 and the second outdoor heat exchanger 21 are reduced to the minimum) and the indoor heat load requirement is still not met (the current indoor temperature is lower than the preset temperature), the second dehumidifying-reheating mode or the third dehumidifying-reheating mode is entered; the compressor 01 improves the capacity output to further increase the heat exchange quantity of the first indoor heat exchanger 08, and switches to the first outdoor heat exchanger 20 or the second outdoor heat exchanger 21 at low pressure to shunt a low-pressure flow excessively output by the compressor 01, so that the heat exchange quantity of the second indoor heat exchanger 09 is kept unchanged, and the stability of humidity control is kept.

When there is a heat load requirement indoors, the first heating mode or second heating mode is entered, and the first defrosting mode or the second defrosting mode is triggered according to a condition corresponding to whether a corresponding outdoor heat exchanger needs defrosting or not.

When the indoor temperature is less than the set temperature, warming is needed, but the heat pump system has problems of frosting and defrosting of the outdoor heat exchanger, which will cause a temperature fluctuation not to meet the requirement, so that defrosting is needed at this time. The heat pump system uses double outdoor heat exchangers, and can realize asynchronous defrosting by adopting the first defrosting mode and the second defrosting mode, and in the defrosting, the indoor heat exchanger still keeps a high pressure state to keep indoor heat output, thereby reducing a great fluctuation of indoor temperature caused by no heating of an indoor heat exchanger in defrosting by an ordinary heat pump air conditioning device.

In some embodiments, a first control table of the operating modes of the heat pump system corresponding to the component control states is shown in the following Table 1:

TABLE 1 first control table of operating modes and component control states

| Illustration | 01 | 02 | 03 | 04 |
|---|---|---|---|---|
| Component Name | Refrigerating/dehumidifying mode | First dehumidifying-reheating mode | Second dehumidifying-reheating mode | Third dehumidifying-reheating mode |
| Compressor 01 | Operate (output regulation) | Operate (output regulation) | Operate (output regulation) | Operate (output regulation) |
| Indoor fan system 07 | Operate (revolution regulation) | Operate (revolution regulation) | Operate (revolution regulation) | Operate (revolution regulation) |
| First four-way valve 02 | Powered down | Powered down | Powered on | Powered down |
| Second four-way valve 03 | Powered down | Powered down | Powered down | Powered on |
| Second control valve 04 | Powered on | Powered on | Powered down | Powered on |
| Third control valve 05 | Powered on | Powered on | Powered on | Powered down |
| First control valve 06 | Powered down | Powered on | Powered on | Powered on |
| First throttle means 12 | Closed | Opened (opening regulation) | Opened (opening regulation) | Opened (opening regulation) |
| Second throttle means 13 | Opened (opening regulation) | Opened (opening regulation) | Opened (opening regulation) | Opened (opening regulation) |
| Third throttle means 22 | Opened (opening regulation) | Opened (opening regulation) | Opened (opening regulation) | Closed/Opened (opening regulation) |
| Fourth throttle means 23 | Opened (opening regulation) | Opened (opening regulation) | Closed/Opened (opening regulation) | Opened (opening regulation) |
| First outdoor fan system 24 | Operate (revolution regulation) | Operate (revolution regulation) | Operate (revolution regulation) | Stop/Operate (revolution regulation) |
| Second outdoor fan system 25 | Operate (revolution regulation) | Operate (revolution regulation) | Stop/Operate (revolution regulation) | Operate (revolution regulation) |

A second control table of the operating modes of the heat pump system corresponding to the component control states is shown in the following Table 2:

TABLE 2 second control table of operating modes and component control states

| Illustration | 05 | 06 | 07 | 08 |
|---|---|---|---|---|
| component Name | First heating mode | Second heating mode | First defrosting mode | Second defrosting mode |
| Compressor 01 | Operate (output regulation) | Operate (output regulation) | Operate (output regulation) | Operate (output regulation) |
| Indoor fan system 07 | Operate (revolution regulation) | Operate (revolution regulation) | Operate (revolution regulation) | Operate (revolution regulation) |
| First four-way valve 02 | Powered on | Powered on | Powered down | Powered on |
| Second four-way valve 03 | Powered on | Powered on | Powered on | Powered down |
| Second control valve 04 | Powered on | Powered on | Powered down | Powered on |
| Third control valve 05 | Powered on | Powered on | Powered on | Powered down |
| First control valve 06 | Powered on | Powered down | Powered down | Powered down |
| First throttle means 12 | Opened (opening regulation) | Closed | Closed | Closed |
| Second throttle means 13 | Opened (opening regulation) | Opened (opening regulation) | Opened (opening regulation) | Opened (opening regulation) |
| Third throttle means 22 | Opened (opening regulation) | Opened (opening regulation) | Opened (opening regulation) | Opened (opening regulation) |
| Fourth throttle means 23 | Opened (opening regulation) | Opened (opening regulation) | Opened (opening regulation) | Opened (opening regulation) |
| First outdoor fan system 24 | Operate (revolution regulation) | Operate (revolution regulation) | Operate (revolution regulation) | Stop |

TABLE 2-continued

| second control table of operating modes and component control states | | | | |
|---|---|---|---|---|
| Illustration | 05 | 06 | 07 | 08 |
| Second outdoor fan system 25 | Operate (revolution regulation) | Operate (revolution regulation) | Stop | Operate (revolution regulation) |

According to the above first control table and second control table, the states of the components of the heat pump system can be controlled according to the operating modes to realize the corresponding functions, the components including the first throttle means 12, the second throttle means 13, the third throttle means 22, the fourth throttle means 23, etc. A regulation mode strategy for the components can be set for the different operating modes; and when the heat pump system operates in the different operating modes, corresponding regulations are performed on the components according to the regulation mode strategy.

For example, according to the regulation modes in brackets in the above first control table and second control table, in the refrigerating/dehumidifying mode, the first dehumidifying-reheating mode, the second dehumidifying-reheating mode, and the third dehumidifying-reheating mode, the output regulation on the compressor 01, the revolution (which is the number of revolutions per unit time) regulation on the indoor fan system 07, the first outdoor fan system 24, and the second outdoor fan system 25, and the opening regulation on the second throttle means 13, the third throttle means 22, and the fourth throttle means 23 can be performed; in the first dehumidifying-reheating mode, the second dehumidifying-reheating mode and the third dehumidifying-reheating mode, the opening regulation on the first throttle means 12 can be performed; in the first heating mode, the second heating mode, the first defrosting mode and the second defrosting mode, the output regulation on the compressor 01, the revolution regulation on the indoor fan system 07, and the opening regulation on the second throttle means 13, the third throttle means 22 and the fourth throttle means 23 can be performed; in the first heating mode, the opening regulation on the first throttle means 12 can be performed; in the first heating mode, the second heating mode and the first defrosting mode, the revolution regulation on the first outdoor fan system 24 can be performed; and in the first heating mode, the second heating mode, and the second defrosting mode, the revolution regulation on the second outdoor fan system 25 can be performed.

Figure 13:
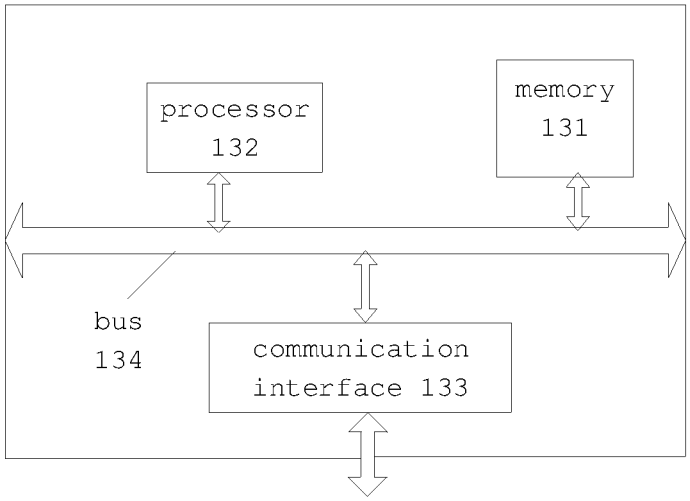
FIG. 13 is a schematic block diagram of a control apparatus of a heat pump system according to some embodiments of the present disclosure.

In some embodiments, FIG. 13 is a schematic block diagram of a control apparatus of a heat pump system according to some embodiments of the present disclosure. As shown in FIG. 13, the apparatus can comprise a memory 131, a processor 132, a communication interface 133, and a bus 134. The memory 131 is used for storing instructions, the processor 132 is coupled to the memory 131, and the processor 132 is configured to perform, based on the instructions stored in the memory 131, the control method of a heat pump system in any of the above embodiments.

The memory 131 can be a high-speed RAM memory, a non-volatile memory, or the like, and the memory 131 can be a memory array. The storage 131 can also be partitioned into blocks, and the blocks can be combined into virtual volumes according to certain rules. The processor 132 can be a central processing unit (CPU), or an application specific integrated circuit (ASIC), or one or more integrated circuits configured to implement the control method of a heat pump system of the present disclosure.

In some embodiments, the present disclosure provides an air conditioning device, comprising the heat pump system according to any of the above embodiments, and the control apparatus of a heat pump system according to any of the above embodiments. The air conditioning device can be a heat pump-type thermostat and humidistat or the like.

In some embodiments, the present disclosure provides a computer-readable storage medium having therein stored computer instructions which, when executed by a processor, implement the control method of a heat pump system according to any of the above embodiments.

According to the heat pump system and the control method and apparatus thereof, the air conditioning device and the storage medium provided by the above embodiments, the heat pump system is used to realize the functions such as dehumidifying-reheating, heating-warming by using the heat of condensation, can realize the heat recovery dehumidifying-reheating and make the air supply temperature adjustable, without the need of an electric heating system, can reduce the energy consumption and improve the energy-saving performance; the double outdoor heat exchangers are used to realize asynchronous defrosting during which the indoor heat exchanger can keep the high pressure state, can keep indoor heat output and reduce the great indoor temperature fluctuation caused by no heating of the indoor heat exchanger in the defrosting, so that use feeling of a user is improved.

It should be appreciated by those skilled in the art, the embodiments of the present disclosure can be provided as a method, system, or computer program product. Accordingly, the present disclosure can take a form of an entire hardware embodiment, an entire software embodiment, or an embodiment combining software and hardware aspects. Moreover, the present disclosure can take a form of a computer program product implemented on one or more computer-usable non-transitory storage media (including, but not limited to, a disk memory, CD-ROM, optical memory, etc.) having computer-usable program code embodied therein.

The method and system of the present disclosure may be implemented in a number of ways. For example, the method and system of the present disclosure can be implemented in software, hardware, firmware, or any combination of software, hardware, and firmware. The above order for the steps of the method is for illustration only, and the steps of the method of the present disclosure are not limited to the order specifically described above unless specifically stated otherwise. Furthermore, in some embodiments, the present disclosure can also be implemented as programs recorded in a recording medium, the programs including machine-readable instructions for implementing the method according to the present disclosure. Thus, the present disclosure also covers a recording medium storing a program for performing the method according to the present disclosure.

The above description is only the preferred embodiments of the present disclosure and not used to limit the present disclosure, and any modifications, equivalent replacements, improvements, etc. made within the spirit and principle of the present disclosure shall be included in the protection scope of the present disclosure.

What is claimed is:

1. A heat pump system, comprising:

an indoor unit, an outdoor unit and a valve assembly; the indoor unit comprising: a compressor, a first control valve a first indoor heat exchanger and a second indoor heat exchanger;

the valve assembly being respectively connected with an exhaust outlet and a suction inlet of the compressor, a first end of the second indoor heat exchanger, and a first end of the outdoor unit, and a second end of the second indoor heat exchanger being connected with a second end of the outdoor unit; the valve assembly being configured to control a flow direction and on-off of refrigerant to form a refrigerant loop; and the first indoor heat exchanger having a first end connected with the exhaust outlet of the compressor and a second end connected with a second connection pipeline between the second end of the second indoor heat exchanger and the second end of the outdoor unit through a first connection pipeline, wherein the first control valve is provided in a pipeline between the first end of the first indoor heat exchanger and the exhaust outlet of the compressor; wherein:

the outdoor unit comprises; a first outdoor heat exchanger and a second outdoor heat exchanger; the valve assembly is respectively connected with the first end of the first outdoor heat exchanger and the first end of the second outdoor heat exchanger; the second end of the first outdoor heat exchanger and the second end of the second outdoor heat exchanger are connected with the second end of the second indoor heat exchanger through the second connection pipeline;

the valve assembly comprises: a first four-way valve and a second four-way valve; a first port (D1) of the first four-way valve and a first port (D2) of the second four-way valve are respectively connected with the exhaust outlet of the compressor, and a second port (E1) of the first four-way valve and a second port (E2) of the second four-way valve are respectively connected with the first end of the second indoor heat exchanger; a third port (C1) of the first four-way valve is connected with the first end of the second outdoor heat exchanger, and a third port (C2) of the second four-way valve is connected with the first end of the first outdoor heat exchanger; and a fourth port (S1) of the first four-way valve and a fourth port (S2) of the second four-way valve are connected with the suction inlet of the compressor.

2. The heat pump system according to claim 1, wherein the valve assembly further comprises: a second control valve and a third control valve;

the second control valve is provided in a pipeline between the second port (E1) of the first four-way valve and the first end of the second indoor heat exchanger; and the third control valve is provided in a pipeline between the second port (E2) of the second four-way valve and the first end of the second indoor heat exchanger.

3. The heat pump system according to claim 2, wherein the outdoor unit comprises: a liquid storage tank;

the second end of the first outdoor heat exchanger and the second end of the second outdoor heat exchanger are respectively connected with a first end of the liquid storage tank; a third throttle means is provided in a pipeline between the second end of the first outdoor heat exchanger and the first end of the liquid storage tank, and a fourth throttle means is provided in a pipeline between the second end of the second outdoor heat exchanger and the first end of the liquid storage tank; and a second end of the liquid storage tank is connected with the second connection pipeline.

4. The heat pump system according to claim 2, wherein the indoor unit comprises: a fifth throttle means; and the fifth throttle means is provided in a third connection pipeline between the suction inlet of the compressor and the second end of the first indoor heat exchanger.

5. The heat pump system according to claim 4, wherein the indoor unit comprises: two sixth throttle means; one sixth throttle means having a first end connected with the third connection pipeline and a second end connected with a pipeline located between the second port of the first four-way valve and the second control valve; the other sixth throttle means having a first end connected with the third connection pipeline and a second end connected with a pipeline located between the second port of the second four-way valve and the third control valve.

6. The heat pump system according to claim 1, wherein stop valves are respectively provided in a pipeline between the third port (C1) of the first four-way valve and the first end of the second outdoor heat exchanger and a pipeline between the third port (C2) of the second four-way valve and the first end of the first outdoor heat exchanger; and a stop valve provided in the second connection pipeline.

7. The heat pump system according to claim 1, wherein the outdoor unit comprises: a first outdoor fan system and a second outdoor fan system, wherein the first outdoor fan system and the first outdoor heat exchanger are located in a first air duct, and the second outdoor fan system and the second outdoor heat exchanger are located in a second air duct.

8. The heat pump system according to claim 1, wherein the indoor unit comprises: an indoor fan system; the indoor fan system, the first indoor heat exchanger and the second indoor heat exchanger being located in one same air duct, wherein indoor return air generated by the indoor fan system sequentially passes through the second indoor heat exchanger and the first indoor heat exchanger, or sequentially passes through the first indoor heat exchanger and the second indoor heat exchanger.

9. The heat pump system according to claim 1, wherein a first throttle means is provided in the first connection pipeline, and a second throttle means is provided in the second connection pipeline.

10. A control method of a heat pump system, applied to control the heat pump system according to claim 2, comprising:

determining an operating mode of the heat pump system; and controlling actions of the first four-way valve, the second four-way valve the first control valve, the second control valve and the third control valve in the heat pump system according to a preset control strategy and based on the operating mode.

11. The control method according to claim 10, wherein the operating mode comprises: at least one of a refrigerating/dehumidifying mode, a first heating mode, a second heating mode, a first dehumidifying-reheating mode, a second dehumidifying-reheating mode, a third dehumidifying-reheating mode, a first defrosting mode, or a second defrosting mode.

12. The control method according to claim 11, further comprising:

when the operating mode is the refrigerating/dehumidifying mode, controlling the first four-way valve to have the first port (D1) connected with the third port (C1) and the second port (E1) connected with the fourth port (S1); controlling the second four-way valve to have the first port (D2) connected with the third port (C2) and the second port (E2) connected with the fourth port (S2); and controlling the first control valve to be in an off state, and controlling the second control valve and the third control valve to be in an on state;

when the operating mode is the first dehumidifying-reheating mode, controlling the first four-way valve to have the first port (D1) connected with the third port (C1) and the second port (E1) connected with the fourth port (S1); controlling the second four-way valve to have the first port (D2) connected with the third port (C2) and the second port (E2) connected with the fourth port (S2); and controlling the first control valve, the second control valve and the third control valve to be in the on state;

when the operating mode is the second dehumidifying-reheating mode, controlling the first four-way valve to have the first port (D1) connected with the second port (E1) and the third port (C1) connected with the fourth port (S1); controlling the second four-way valve to have the first port (D2) connected with the third port (C2) and the second port (E2) connected with the fourth port (S2); and controlling the first control valve and the third control valve to be in the on state, and controlling the second valve to be in the off state;

when the operating mode is the third dehumidifying-reheating mode, controlling the first four-way valve to have the first port (D1) connected with the third port (C1) and the second port (E1) connected with the fourth port (S1); controlling the second four-way valve to have the first port (D2) connected with the second port (E2) and the third port (C2) connected with the fourth port (S2); and controlling the first control valve and the second control valve to be in the on state, and controlling the third control valve to be in the off state;

when the operating mode is the first heating mode, controlling the first four-way valve to have the first port (D1) connected with the second port (E1) and the third port (C1) connected with the fourth port (S1); controlling the second four-way valve to have the first port (D2) connected with the second port (E2) and the third port (C2) connected with the fourth port (S2); and controlling the first control valve, the second control valve and the third control valve to be in the on state;

wherein the operating mode is the second heating mode, controlling the first four-way valve to have the first port (D1) connected with the second port (E1) and the third port (C1) connected with the fourth port (S1); controlling the second four-way valve to have the first port (D2) connected with the second port (E2) and the third port (C2) connected with the fourth port (S1); and controlling the first control valve to be in the off state; and controlling the second control valve and the third control valve to be in the on state;

when the operating mode is the first defrosting mode, controlling the first four-way valve to have the first port (D1) connected with the third port (C1) and the second port (E1) connected with the fourth port (S1); controlling the second four-way valve to have the first port (D2) connected with the second port (E2) and the third port (C2) connected with the fourth port (S2); and controlling the first control valve and the second control valve to be in the off state, and controlling the third control valve to be in the on state; or when the operating mode is the second defrosting mode, controlling the first four-way valve to have the first port (D1) connected with the second port (E1) and the third port (C1) connected with the fourth port (S1); controlling the second four-way valve to have the first port (D2) connected with the third port (C2) and the second port (E2) connected with the fourth port (S2); and controlling the first control valve and the third control valve to be in the off state, and controlling the second control valve to be in the on state.

13. A control apparatus of a heat pump system, comprising: a memory; and a processor coupled to the memory, the processor being configured to perform, based on instructions stored in the memory, the method according to claim 10.

14. An air conditioning device, comprising: the heat pump system according to claim 1.

15. A computer-readable storage medium having therein stored computer instructions which, when executed by a processor, perform the method according to claim 10.

* * * * *